US008421678B2

(12) United States Patent
Sakiyama et al.

(10) Patent No.: US 8,421,678 B2
(45) Date of Patent: Apr. 16, 2013

(54) ANTENNA APPARATUS PROVIDED WITH RADIATION CONDUCTOR WITH NOTCHED PORTION

(75) Inventors: Kazuyuki Sakiyama, Osaka (JP); Akira Minegishi, Osaka (JP)

(73) Assignee: Panasonic Corporation, Osaka (JP)

( * ) Notice: Subject to any disclaimer, the term of this patent is extended or adjusted under 35 U.S.C. 154(b) by 771 days.

(21) Appl. No.: 12/531,122

(22) PCT Filed: Apr. 9, 2008

(86) PCT No.: PCT/JP2008/000918

§ 371 (c)(1), (2), (4) Date: Sep. 14, 2009

(87) PCT Pub. No.: WO2008/132785

PCT Pub. Date: Nov. 6, 2008

(65) Prior Publication Data

US 2010/0019976 A1 Jan. 28, 2010

(30) Foreign Application Priority Data

Apr. 12, 2007 (JP) ..... 2007-104805

(51) Int. Cl.
*H01Q 1/38* (2006.01)

(52) U.S. Cl.
USPC ..... 343/700 MS

(58) Field of Classification Search ..... 343/700 MS
See application file for complete search history.

(56) References Cited

U.S. PATENT DOCUMENTS 5,216,430 A * 6/1993 Rahm et al. ..... 343/700 MS
5,410,323 A * 4/1995 Kuroda ..... 343/700 MS
6,211,825 B1 * 4/2001 Deng ..... 343/700 MS
6,639,556 B2 * 10/2003 Baba ..... 343/700 MS
7,482,977 B2 1/2009 Kuroda et al.
2010/0019976 A1 * 1/2010 Sakiyama et al. ..... 343/700 MS

FOREIGN PATENT DOCUMENTS

| | | |
|---|---|---|
| JP | 5-129825 | 5/1993 |
| JP | 11-355009 | 12/1999 |
| JP | 2000-77929 | 3/2000 |
| JP | 2003-51710 | 2/2003 |
| JP | 2005-79972 | 3/2005 |
| JP | 2005-278067 | 10/2005 |

OTHER PUBLICATIONS

International Preliminary Report on Patentability, and Written Opinion of the International Searching Authority issued Oct. 13, 2009 in PCT/JP2008/000918 (with English translations).

Garg et al., "Microstrip Antenna Design Handbook" Artech House, Boston, pp. 8-12, Nov. 2000.

Koyasu et al., "Improvement of Transmission Characteristic with Passive Equalizer and Fast Ethernet Cable" The Institute of Electronics, Information and Communication Engineers, vol. J87-C, No. 11, pp. 873-880, Nov. 2004 (with partial English translation).

* cited by examiner

*Primary Examiner* — Robert Karacsony
(74) *Attorney, Agent, or Firm* — Wenderoth, Ling & Ponack, L.L.P.

(57) ABSTRACT

An antenna apparatus includes a dielectric substrate including a ground conductor formed on a back surface thereof, and a radiation conductor formed on a front surface of the dielectric substrate. Upon directly transmitting and receiving a wireless digital signal via a feed point of the radiation conductor, formation of notched portions at sides of the radiation conductor, which intersect an electric field plane defined by an electric field when the antenna apparatus is excited, leads to reduction in the waveform distortion of waveform of the transmitted wireless digital signal.

8 Claims, 15 Drawing Sheets

ANTENNA APPARATUS PROVIDED WITH RADIATION CONDUCTOR WITH NOTCHED PORTION

BACKGROUND OF THE INVENTION

1. Technical Field

The present invention relates to an antenna apparatus. In particular, the present invention relates to an antenna apparatus for directly and wirelessly transmitting and receiving a wireless digital signal.

2. Background Art

Wideband antenna apparatuses for directly and wirelessly transmitting and receiving wireless digital signals have been widespread. Patent Document 1 discloses a microstrip antenna according to a prior art, in which the occurrence of a higher harmonic mode is reduced within a wide band. Paying attention to the distribution of the respective resonance modes of the microstrip antenna, the Patent Document 1 controls the antenna characteristics by suppressing higher-order frequency resonance modes by providing notched portions at four corners of a radiation conductor plate formed on a surface of a dielectric substrate.

Patent Document 1: Japanese patent laid-open publication No. JP 05-129825-A.

Patent Document 2: Japanese patent laid-open publication No. JP 2005-278067-A.

Patent Document 3: Japanese patent laid-open publication No. JP 2005-079972-A.

Non-Patent Document 1: Ramesh Garg, et al., "Microstrip antenna Design Handbook", Artech House, pp. 8-12, November 2000.

Non-Patent Document 2: Osamu Koyasu at al., "Improvement of Transmission Characteristic with Passive Equalizer and Fast Ethernet Cable" The Institute of Electronics, Information and Communication Engineers, Transaction C, Vol. J87-C, No. 11, pp. 873-880, Nov. 1, 2004.

SUMMARY OF THE INVENTION

However, when a wireless digital signal of a rectangular wave is directly and wirelessly transmitted and received by the above-mentioned microstrip antenna according to the prior art, higher harmonic components are attenuated as compared with the fundamental frequency component of the rectangular wave (for example, refer to the characteristics of a transmission attenuation $S_{21}$ of an oval dipole wideband antenna apparatus according to a prior art at the higher-order degrees shown in FIG. 31 which will be described in detail later). As a result, there has been such a problem that the waveform of the wireless digital signal received at the receiving side is distorted.

An object of the present invention is to provide an antenna apparatus capable of solving the above-mentioned problem, and capable of reducing the waveform distortion caused by the higher harmonic components of rectangular waveforms reduced as compared with the fundamental frequency component when a wireless digital signal is directly and wirelessly transmitted and received by the baseband transmission.

According to one aspect view of the invention, there is provided an antenna apparatus antenna apparatus including (a) a dielectric substrate having a ground conductor formed on a back surface thereof and (b) a radiation conductor formed on a front surface of the dielectric substrate, the antenna apparatus directly transmitting and receiving a wireless digital signal by baseband transmission via a feed point of the radiation conductor. The radiation conductor reduces waveform distortion of a transmitted wireless digital signal by forming at least one notched portion at at least one side of sides of the radiation conductor, which intersect an electric field plane defined by an electric field when the antenna apparatus is excited, so that at least a third-order harmonic signal level becomes larger than a fundamental wave signal level.

In the above-mentioned antenna apparatus, at least one notched portion is formed so that at least the third-order harmonic signal level becomes larger than the fundamental wave signal level and a second-order harmonic signal level.

In addition in the above-mentioned antenna apparatus, the notched portion is formed substantially at a center of the side intersecting the electric field plane of the radiation conductor.

Further, in the above-mentioned antenna apparatus, a sum of lengths of the notched portions on the sides of the radiation conductor is set to be shorter than one-sixth of a length of a whole circumference of the radiation conductor when the notched portions are not formed.

Still further, in the above-mentioned antenna apparatus, the notched portion is formed so as not to be located at one of a position of a center of gravity of the radiation conductor and the feed point.

In addition, in the above-mentioned antenna apparatus, the notched portions are formed at both sides of the radiation conductor, which intersect the electric field plane, respectively, and are formed symmetrically with respect to a magnetic field plane orthogonal to the electric field plane.

Further, in the above-mentioned antenna apparatus, the dielectric substrate further includes at least one groove, which is formed in at least one position that intersects the electric field plane in the vicinity of the notched portion.

Still further, in the above-mentioned antenna apparatus, a depth of each of the grooves is set to one value selected within a range from zero to a value equal to a thickness of the dielectric substrate.

In addition, in the above-mentioned antenna apparatus, a sum of lengths of sides of the groove parallel to the sides of the radiation conductor is set to be shorter than one-sixth of a length of a whole circumference of the radiation conductor when the notched portions are not formed.

Further, in the above-mentioned antenna apparatus, each of the grooves is formed at a position located within a range from an end portion of the dielectric substrate to a position of a center of gravity or the feed point of the radiation conductor.

Still further, in the above-mentioned antenna apparatus, the dielectric substrate includes at least two grooves, and the two grooves are formed symmetrically with respect to the magnetic field plane.

According to the antenna apparatus of the present invention, the radiation conductor has at least one notched portion formed on at least one side of sides of the radiation conductor so that at least a third-order harmonic signal level becomes larger than a fundamental wave signal level, where the sides intersects an electric field plane defined by an electric field when the antenna apparatus is excited. Therefore, it is possible to reduce the radiation intensity of the fundamental frequency component as compared with the radiation intensity of the higher harmonic components, and it is possible to remarkably reduce the waveform distortion caused by the higher harmonic components of rectangular waveforms reduced as compared with the fundamental frequency component when a wireless digital signal is directly and wirelessly transmitted and received by the baseband transmission.

In addition, since the operation of reducing the fundamental frequency component of the rectangular waveform to be transmitted is performed by employing passive devices, the circuit configuration is simple, and it is possible to reduce the power consumption as compared with the power consumption when active devices are employed.

DESCRIPTION OF REFERENCE SYMBOLS

Figure 1:
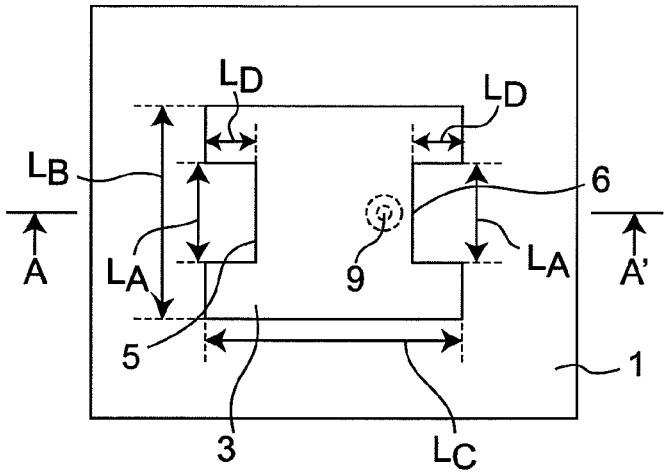
FIG. 1 is a plan view showing a configuration of an antenna apparatus according to a first preferred embodiment of the present invention.

1, 1A . . . dielectric substrate;
2 . . . ground conductor;
3, 3A . . . radiation conductor;
5, 6, 5A, 5B, 5C, 5D, 6A, 6B, 6C, 6D . . . notched portion;
7, 8, 7A, 7B, 7C . . . groove;
9 . . . feed point;

10 . . . coaxial cable;
11 . . . central conductor;
12 . . . dielectric;
13 . . . ground conductor;
14 . . . through hole conductor;
14*h* . . . through hole;
15, 35 . . . antenna apparatus;
16 . . . rectangular wave signal generator;
17 . . . clock signal generator;
18 . . . two-port model of antenna;
C1, C11, C12, C13 . . . capacitor,
L0-L2, L11-L13, L21-L23 . . . inductor; and
R1, R3, R4 . . . radiation space resistance.

DETAILED DESCRIPTION OF THE INVENTION

Preferred embodiments according to the present invention will be described below with reference to the attached drawings. Components similar to each other are denoted by the same reference numerals and will not be described herein in detail.

First Preferred Embodiment

Figure 2:
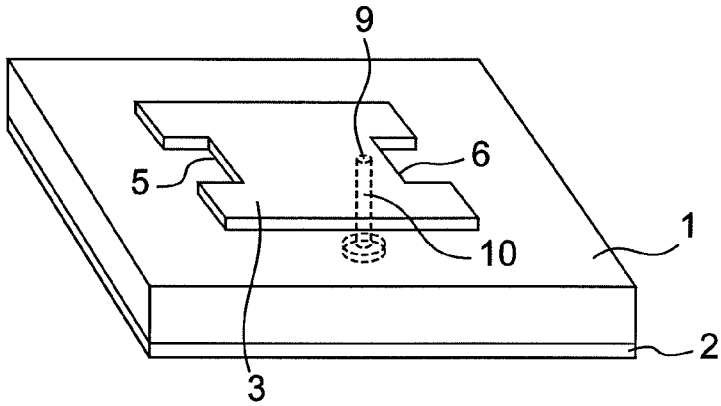
FIG. 2 is a perspective view showing an appearance of the antenna apparatus of FIG. 1.
Figure 3:
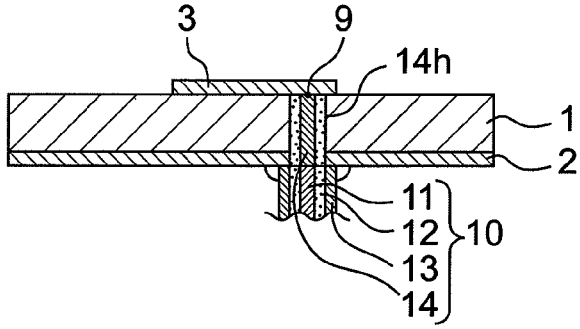
FIG. 3 is a longitudinal sectional view along an A-A' plane of FIG. 1.

FIG. 1 is a plan view showing a configuration of an antenna apparatus according to a first preferred embodiment of the present invention, FIG. 2 is a perspective view showing an appearance of the antenna apparatus of FIG. 1, and FIG. 3 is a longitudinal sectional view along an A-A' plane of FIG. 1. The antenna apparatus according to the present preferred embodiment is, for example, a microstrip antenna for use in a wireless bus, a wireless interconnection or the like for directly transmitting and receiving, for example, a wireless digital signal by baseband transmission. Referring to FIGS. 1 to 3, the antenna apparatus is configured by including a dielectric substrate 1, a ground conductor 2, a radiation conductor 3 having a length $L_C$ and a width $L_B$, and a feeder 10. The radiation conductor 3 has notched portions 5 and 6 at the peripheral portions thereof. Each of the notched portions 5 and 6 is formed substantially at the center of a side of the radiation conductor 3. The sides of the radiation conductor 3, at which the notched portions 5 and 6 are formed, intersect an electric field plane (referred to as an E plane hereinafter) to which the direction of radiation electric field is parallel. The notched portion 5 has a depth $L_D$ and a length (a width) $L_A$, and the notched portion 6 has a depth $L_D$ and a length $L_A$. The notched portions 5 and 6 are formed symmetrically with respect to an H plane.

The ground conductor 2 is formed on a back surface of the dielectric substrate 1, and the radiation conductor 3 that serves as a radiator is formed on a front surface of the dielectric substrate 1. A coaxial cable 10 that serves as a feeder is configured by including a central conductor 11, a ground conductor 13, and a dielectric 12 for insulation between the conductors 11 and 13. In this case, the central conductor 11 is connected to a feed point 9 of the radiation conductor 3 via a through hole conductor 14 filled into a through hole 14*h* penetrating the dielectric substrate 1 in the thickness direction thereof. In addition, the ground conductor 13 is connected to the ground conductor 2. The coaxial cable 10 feeds power from the feed point 9 to the radiation conductor 3 so that a digital transmission signal is transmitted and received. A wireless signal fed by the coaxial cable 10 is fed to the feed point 9 of the radiation conductor 3 so that the radiation conductor 3 is excited, by which the wireless signal is radiated into a free space.

Figure 4:
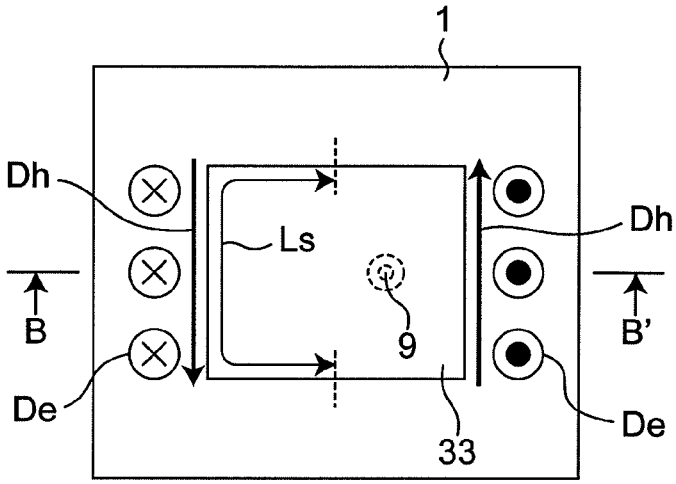
FIG. 4 is a plan view showing a configuration of an antenna apparatus having a radiation conductor 33 without any notched portions 5 and 6.
Figure 5:
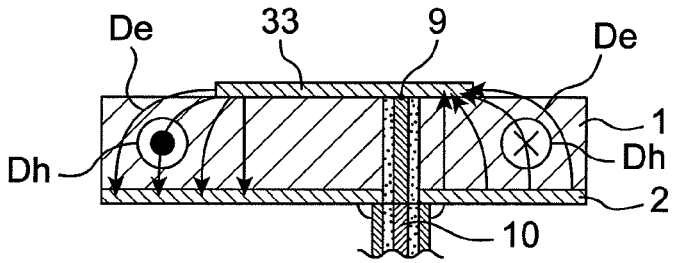
FIG. 5 is a longitudinal sectional view along a B-B' plane of FIG. 4.

Next, referring to FIGS. 4 and 5, a size setting method of the notched portions 5 and 6 of FIG. 1 is described. FIG. 4 is a plan view showing a configuration of an antenna apparatus having a radiation conductor 33 without any notched portions 5 and 6. FIG. 5 is a longitudinal sectional view along a B-B' plane of FIG. 4. Referring to FIGS. 4 and 5, a flow of electric lines of force at one moment is schematically shown in order to show a state of vibration of an electric field at the lowest frequency (referred to as a fundamental frequency hereinafter) when the resonance of the electromagnetic field occurs between the radiation conductor 33 and the ground conductor 2. The direction of the electric lines of force is shown by "De", and the direction of the magnetic current is shown by "Dh". In this case, a resonance field is distributed in a direction almost parallel to the E plane, and is symmetric with respect to the magnetic field plane (referred to as the H plane hereinafter) orthogonal to the E plane. The E plane extends in the thickness direction of the dielectric substrate 1 in the B-B' plane of FIG. 5, and is parallel to the B-B' plane. The H plane is orthogonal to the E plane, and exists in the thickness direction of the dielectric substrate 1. The resonance field at the fundamental frequency as described above becomes a standing wave having a node at the H plane portion of the radiation conductor 33. The resonance field corresponding to $\lambda/2$ wavelength exists as the standing wave along the peripheral portions of the radiation conductor 33 as described above. Therefore, as shown in FIG. 4, it is considered that fundamental spatial harmonic components contribute to the electromagnetic radiation at the fundamental resonance frequency, in consideration of spatial harmonic components of the spatial intensity distribution of the standing wave of the electric field along a cycle length Ls of the standing wave distribution.

Therefore, in the present preferred embodiment, in order to suppress the fundamental frequency component, the length $L_A$ of each of the notched portions 5 and 6 is set to be shorter than one third of the cycle length Ls of the standing wave distribution so that the fundamental component of the spatial harmonic components is suppressed. In other words, each of the lengths $L_A$ and $L_A$ of the notched portions 5 and 6 is set to be shorter than the length of one-sixth of the length of the whole circumference of the radiation conductor 33 when the notched portions 5 and 6 are not formed. Namely, the setting is achieved so that the following Equation (1) holds in FIGS. 1 to 3:

$$L_A<(L_B+L_C)/3 \quad (1)$$

In addition, the notched portions 5 and 6 are provided in positions which do not include any intersection in the H plane that coincides with the node of the resonance field of the fundamental frequency and the radiation conductor 3, and include the belly portions of the standing wave distribution at the fundamental frequency of the electric field, i.e., intersection portions with the E plane where a leakage field at the peripheral portion of the radiation conductor 3 becomes large. In addition, the notched portions 5 and 6 are formed so as not to be positioned at the position of a center of gravity of the radiation conductor 3 so that the resonance at the fundamental resonance frequency is not hindered, and are formed so as not to be positioned at the feed point 9 so that the feeding is not disturbed. With this arrangement, it is possible to suppress a value close to the peak of the standing wave distribution of the fundamental frequency component.

Figure 6:
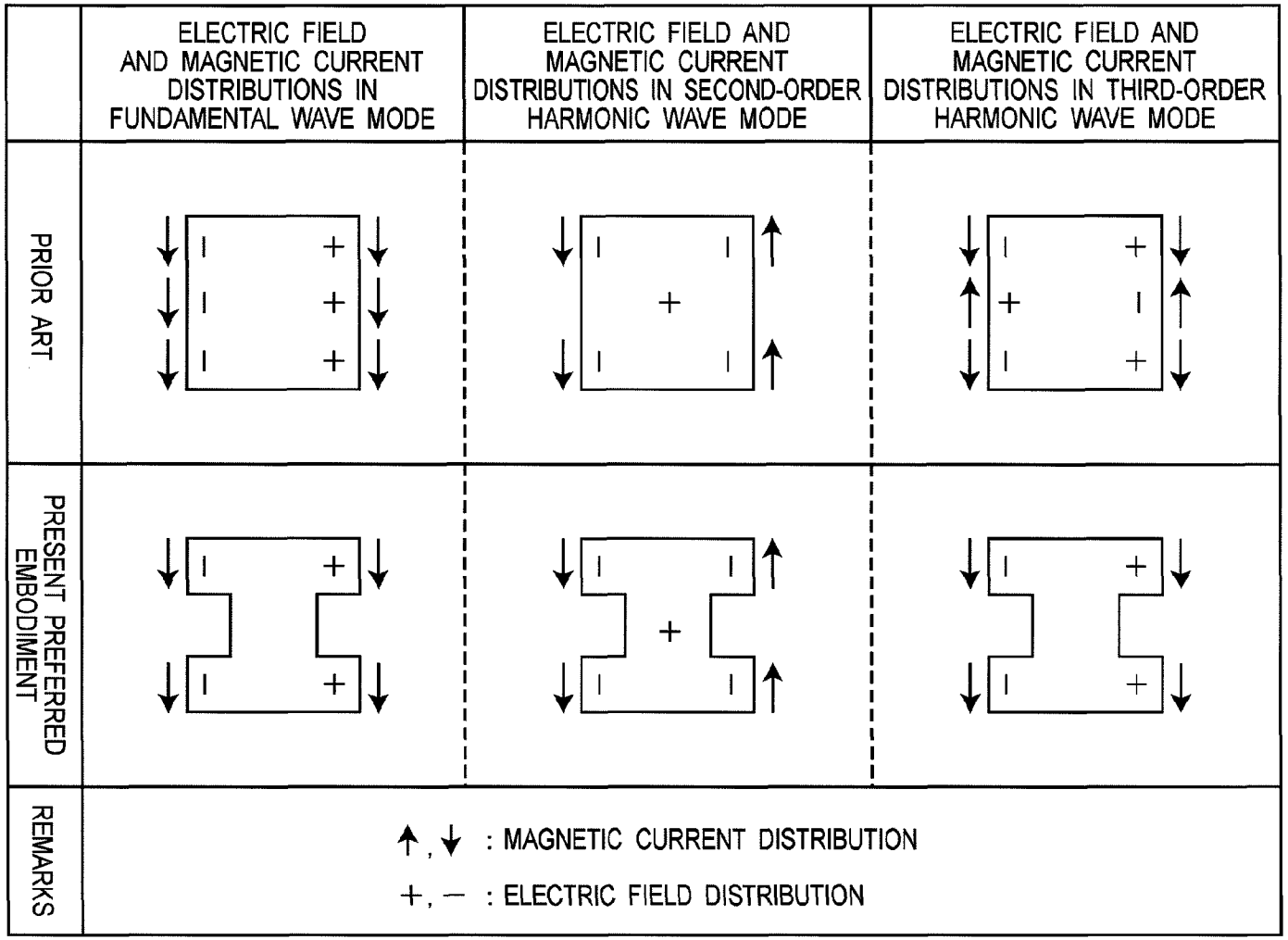
FIG. 6 is a diagram for comparing electric field and magnetic current distributions in each mode of an antenna apparatus according to a prior art without any notched portions 5 and 6, with those of the antenna apparatus according to the present preferred embodiment with the notched portions 5 and 6.

The operation and effects of the antenna apparatus having the above configuration are described below. FIG. 6 is a diagram for comparing electric field and magnetic current distributions in each mode of the antenna apparatus according to the prior art without any notched portions 5 and 6, with those of the antenna apparatus according to the present preferred embodiment with the notched portions 5 and 6. In FIG. 6, the following modes are defined in the increasing order of natural oscillation in each radiation conductor: (a) a fundamental wave mode which is an operation mode of the fundamental frequency component, (b) a second-order harmonic wave mode which is an operation mode of the second-order harmonic wave component, and (c) a third-order harmonic wave mode which is an operation mode of the third-order harmonic wave component. As shown in FIG. 6, in the fundamental wave mode, the notched portions 5 and 6 are provided at the radiation conductor 3 in the antenna apparatus according to the present preferred embodiment, and therefore, the overall magnetic current distribution is reduced as compared with the same distribution when the notched portions 5 and 6 are not provided. In the second-order mode, there is no large difference between both of them. In the third-order harmonic wave mode, the magnetic current is cancelled and reduced in the antenna apparatus according to the prior art, however, in the antenna apparatus according to the present preferred embodiment, a magnetic current at almost the same level as the fundamental wave mode is generated since the notched portions 5 and 6 are provided at the radiation conductor 3. Therefore, it can be understood that the magnetic current distribution is reduced in the fundamental wave mode, and the fundamental frequency component is suppressed in the antenna apparatus according to the present preferred embodiment as compared with the case where the notched portions 5 and 6 are not provided.

Figure 7:
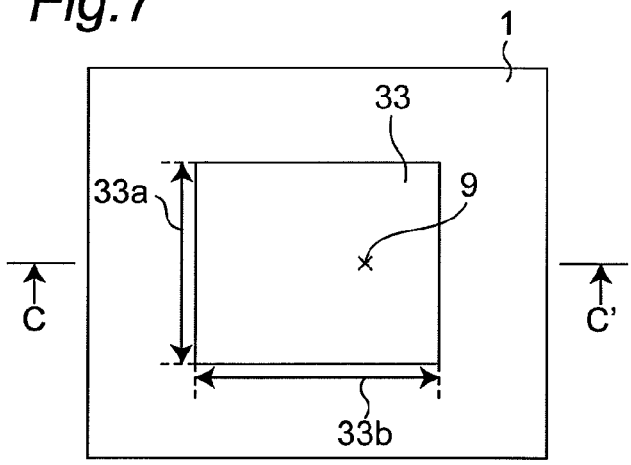
FIG. 7 is a plan view showing a configuration of the antenna apparatus according to the prior art without any notched portions 5 and 6.
Figure 8:
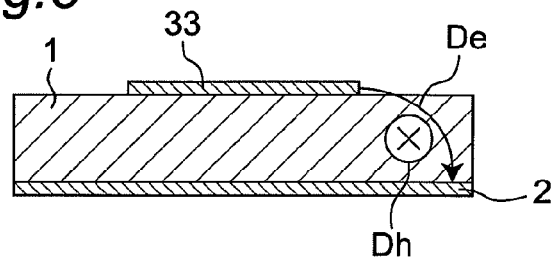
FIG. 8 is a longitudinal sectional view along a C-C' plane of FIG. 7.
Figure 9:
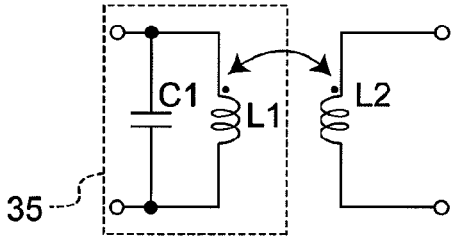
FIG. 9 is a circuit diagram showing an equivalent circuit of the antenna apparatus of FIG. 7.

FIG. 7 is a plan view showing a configuration of the antenna apparatus according to the prior art without any notched portions 5 and 6, FIG. 8 is a longitudinal sectional view along a C-C' plane of FIG. 7, and FIG. 9 is a circuit diagram showing an equivalent circuit of the antenna apparatus of FIG. 7. It is noted that the coaxial cable 10 is not shown in FIG. 8. Referring to FIGS. 7 and 8, in the antenna apparatus according to the prior art, a radiation electromagnetic field from the antenna apparatus is formed by a so-called leakage field distributed at the end portions of the radiation conductor 33 among the electric field between the radiation conductor 33 and the ground conductor 2, and electromagnetic coupling due to a magnetic current induced by the leakage field. Therefore, as shown in the equivalent circuit of FIG. 9, the antenna apparatus according to the prior art without any notched portions can be expressed by a model including a capacitor C1 between the radiation conductor 33 and the ground conductor 2, and inductors L1 and L2 which represent a mutual induction with the free space side.

Figure 10:
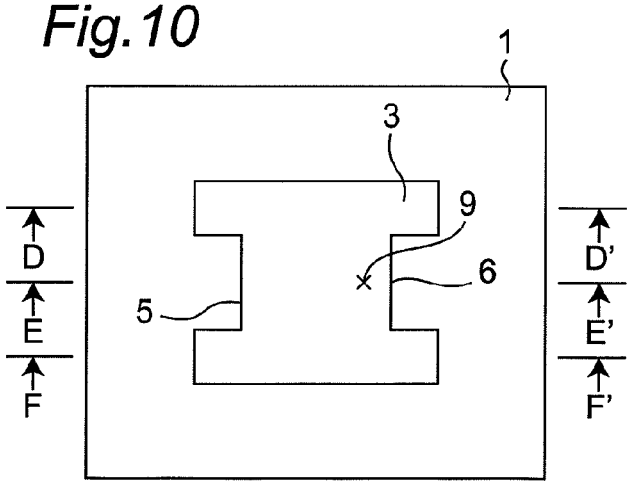
FIG. 10 is a plan view showing a configuration of the antenna apparatus according to the present preferred embodiment with the notched portions 5 and 6.
Figure 11:
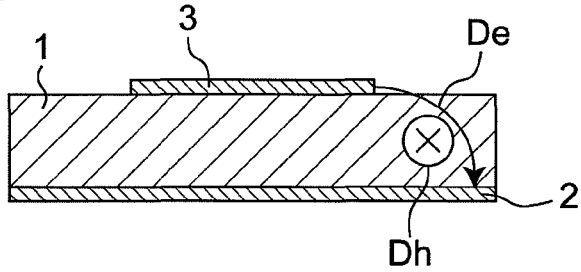
FIG. 11 is a longitudinal sectional view along a D-D' plane and an F-F' plane of FIG. 10.
Figure 12:
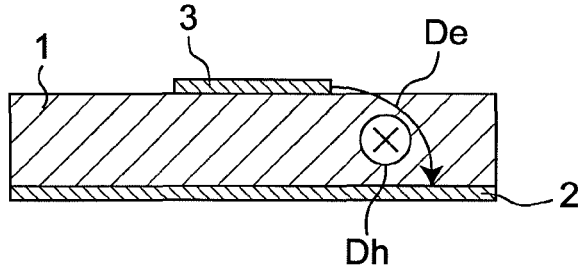
FIG. 12 is a longitudinal sectional view along an E-E' plane of FIG. 10.
Figure 13:
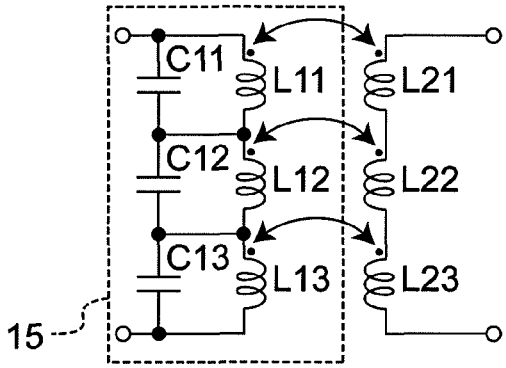
FIG. 13 is a circuit diagram showing an equivalent circuit of the antenna apparatus of FIG. 10.

FIG. 10 is a plan view showing a configuration of the antenna apparatus according to the present preferred embodiment with the notched portions 5 and 6, FIG. 11 is a longitudinal sectional view along a D-D' plane and an F-F' plane of FIG. 10, FIG. 12 is a longitudinal sectional view along an E-E' plane of FIG. 10, and FIG. 13 is a circuit diagram showing an equivalent circuit of the antenna apparatus of FIG. 10. It is noted that the coaxial cable 10 is not shown in FIG. 12. Referring to FIG. 10, since the radiation conductor 33 is provided with the notched portions 5 and 6 in the antenna apparatus according to the present preferred embodiment, it can be considered that the radiation conductor 3 is configured by three rectangular portions defined by the notched portions 5 and 6. As shown in FIG. 13, it is possible to represent the antenna apparatus according to the present preferred embodiment by a model including capacitors C11, C12 and C13 between the respective portions of the radiation conductor 33 and the ground conductor 2, and inductors L11 to L13 and L21 to L23 which represent mutual induction with the free space side.

Figure 14:
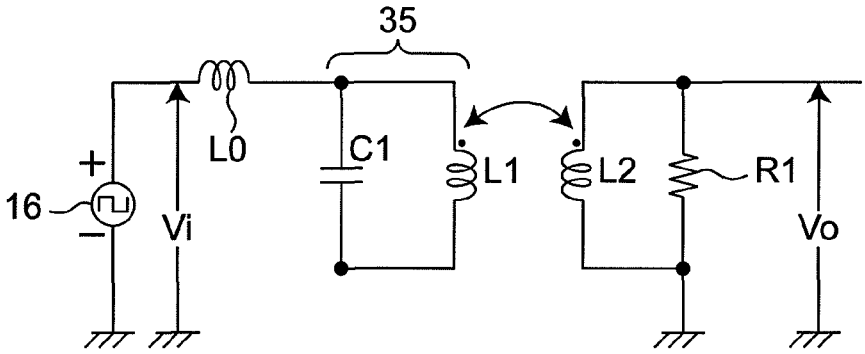
FIG. 14 is a circuit diagram showing a simulation circuit for simulating the antenna apparatus according to the prior art that employs the equivalent circuit of FIG. 9.

FIG. 14 is a circuit diagram showing a simulation circuit for simulating the antenna apparatus according to the prior art that employs the equivalent circuit of FIG. 9. Referring to FIG. 14, the simulation circuit for simulating the antenna apparatus according to the prior art is configured by including a rectangular wave signal generator 16, an inductor L0, an antenna apparatus 35 including the capacitor C1 and the inductor L1, the inductor L2, and a radiation space resistance R1. The rectangular wave signal generator 16 generates a rectangular wave signal having a sampling frequency of 1 GHz and an amplitude level Vi of 1 V, and outputs the rectangular wave signal. In the present simulation, an inductance of the inductor L0 was set to 1 nH, an electrostatic capacitance of the capacitor C1 was set to 5 pF, an inductance of each of the inductors L1 and L2 was set to 5 nH, and a resistance of the radiation space resistance R1 was set to 50Ω. In addition, a mutual coupling coefficient of the inductors L1 and L2 was approximated to 0.9. The rectangular wave signal from the rectangular wave signal generator 16 is transmitted to the radiation space resistance R1 via the antenna apparatus 35, and a voltage Vo measured on the space side is simulated.

Figure 15:
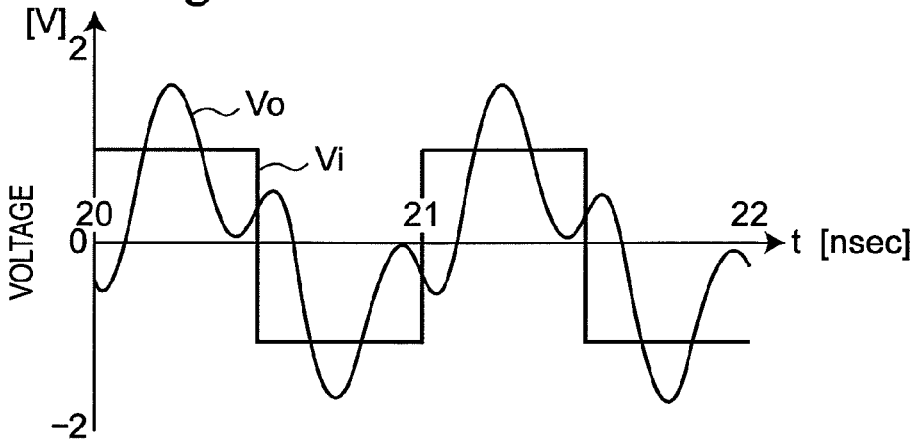
FIG. 15 is a waveform chart showing results of simulations using the simulation circuit of FIG. 14.

FIG. 15 is a waveform chart showing results of simulations using the simulation circuit of FIG. 14. Referring to FIG. 15, it can be found that the waveform of the voltage Vo on the radiation space resistance R1 side is distorted because of the characteristics of the antenna apparatus 35, as compared with the rectangular wave Vi of the input signal.

Figure 16:
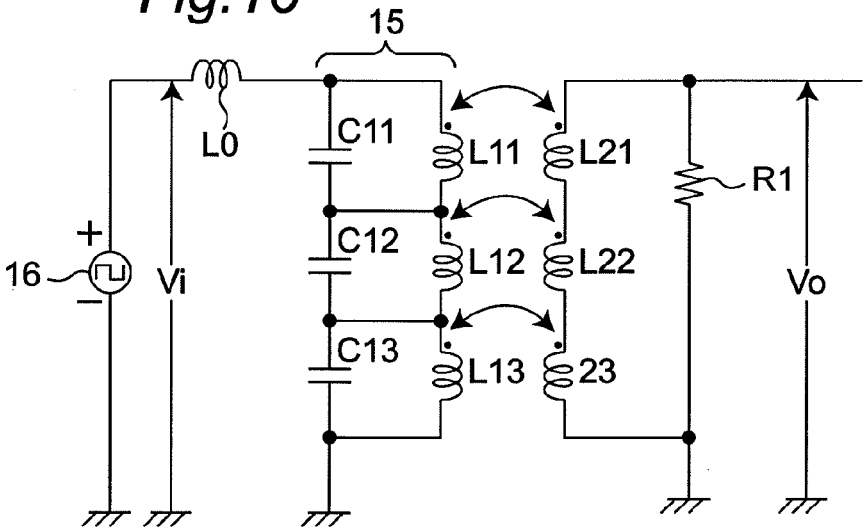
FIG. 16 is a circuit diagram showing a circuit for simulating the antenna apparatus according to the present preferred embodiment that employs the equivalent circuit of FIG. 13.

FIG. 16 is a circuit diagram showing a circuit for simulating the antenna apparatus according to the present preferred embodiment that employs the equivalent circuit of FIG. 13. Referring to FIG. 16, the simulation circuit for simulating the antenna apparatus according to the present preferred embodiment is configured by including the rectangular wave signal generator 16, the inductor L0, an antenna apparatus 15 including the capacitors C11 to C13 and the inductors L11 to L13, inductors L21 to L23, and the radiation space resistance R1. The rectangular wave signal generator 16 generates a rectangular wave signal having a sampling frequency of 1 GHz and an amplitude level Vi of 1 V, and outputs the rectangular wave signal. In the present simulation, the inductance of the inductor L0 was set to 1 nH, each of electrostatic capacitances of the capacitors C11 and C13 was set to 2 pF, each of inductances of the inductors L11, L13, L21 and L23 was set to 2 nH, each of inductances of the inductors L12 and L22 was set to 1 nH, and the resistance of the radiation space resistance R1 was set to 50Ω. In addition, a mutual coupling coefficient of the inductors L11 and L21, and a mutual coupling coefficient of the inductors L13 and L23 were each approximated to 0.9, and a mutual coupling coefficient of the inductors L12 and L22 was approximated to 0.2. The rectangular wave signal from the rectangular wave signal generator 16 is transmitted to the radiation space resistance R1 via the antenna apparatus 15, and the voltage Vo measured on the space side is simulated.

Figure 17:
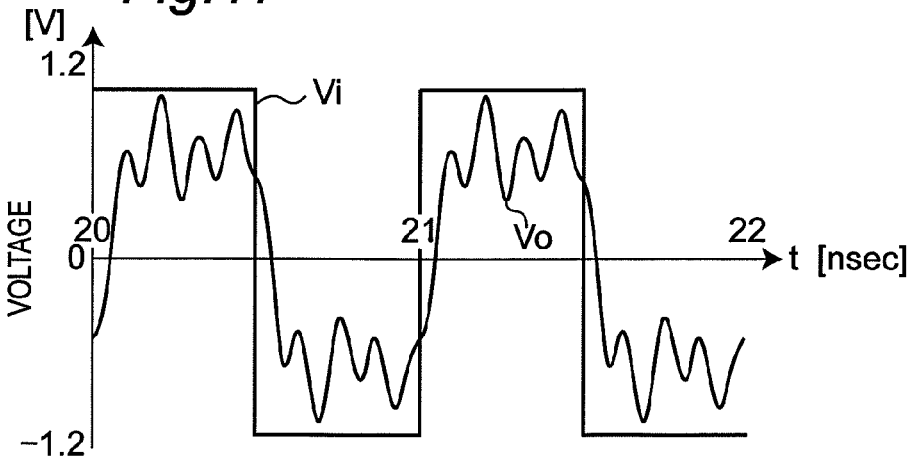
FIG. 17 is a waveform chart showing results of simulations performed by using the simulation circuit of FIG. 16.

FIG. 17 is a waveform chart showing results of simulations performed by using the simulation circuit of FIG. 16. Referring to FIG. 17, since the fundamental frequency component is reduced from the waveform of the voltage Vo on the radiation space resistance R1 side as compared with FIG. 15, the amplitude of the voltage Vo is reduced. However, the degree of distortion of the rectangular wave is reduced due to a reduction in a difference between the higher harmonic components and the fundamental frequency component.

Figure 18:
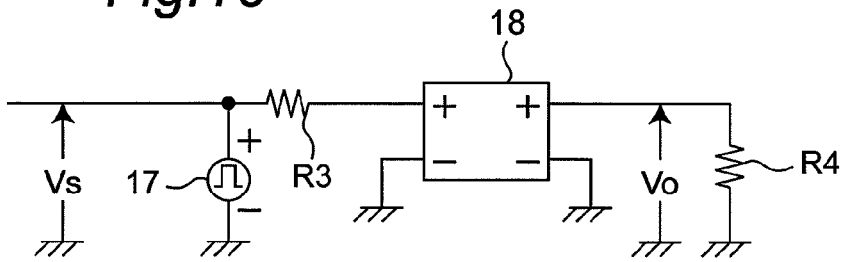
FIG. 18 is a simulation circuit diagram of comparative examples that use an electromagnetic field simulator.

Next, the antenna apparatus according to the prior art and the antenna apparatus according to the present preferred embodiment were subjected to comparative experiments by using an electromagnetic field simulator capable of taking the differences in the antenna structure directly into consideration. FIG. 18 is a simulation circuit diagram of comparative examples that use the electromagnetic field simulator. In the comparative experiments, the radiation conductor 33 of the antenna apparatus according to the prior art was set to have a length 33*a* of 15.9 mm and a width 33*b* of 24.4 mm, a relative permittivity of the dielectric substrate 1 was set to 2.5, the radiation conductor 3 of the antenna apparatus according to the present preferred embodiment was set to have the length $L_B$ of 15.9 mm and the width $L_C$ of 24.4 mm, and the notched portions 5 and 6 was set to have the lengths $L_A$ and $L_A$ of 10.7 mm and the depths $L_D$ and $L_D$ of 0.82 mm. In addition, a transmitter side load R3 was set to 50Ω, and a space side load R4 was set to 1 kΩ. A two-port model 18 of the antenna was constituted by pairing these antenna models on the transmitting side and the receiving side, a pseudo-M-sequence random clock signal Vs with 1-GHz sampling frequency generated by a clock signal generator 17 was transmitted from the transmitting side, and eye pattern analysis of the signal waveform of the signal Vo received on the receiving side was performed. An analysis method employed includes obtaining a transfer function between the transmitting side and the receiving side by an electromagnetic field simulation, and evaluating the transmission of the pseudo-M-sequence random clock signal Vs using the transfer function.

Figure 19:
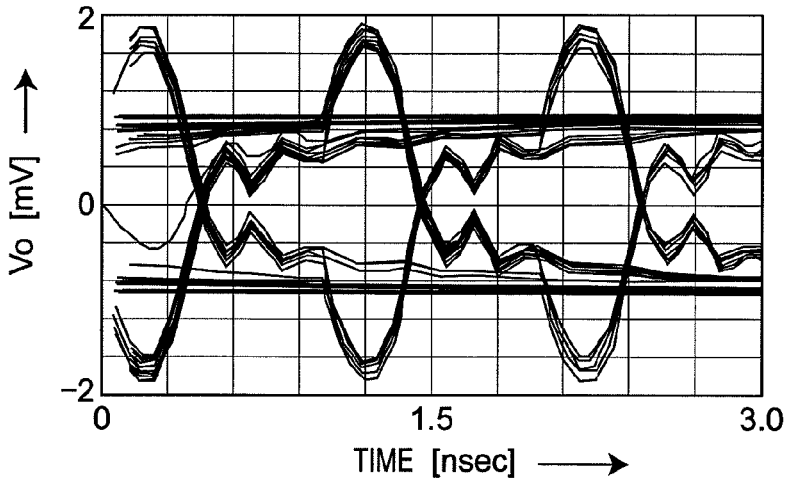
FIG. 19 is a waveform chart showing results of simulations of eye pattern of a received signal received by the antenna apparatus according to prior art.
Figure 20:
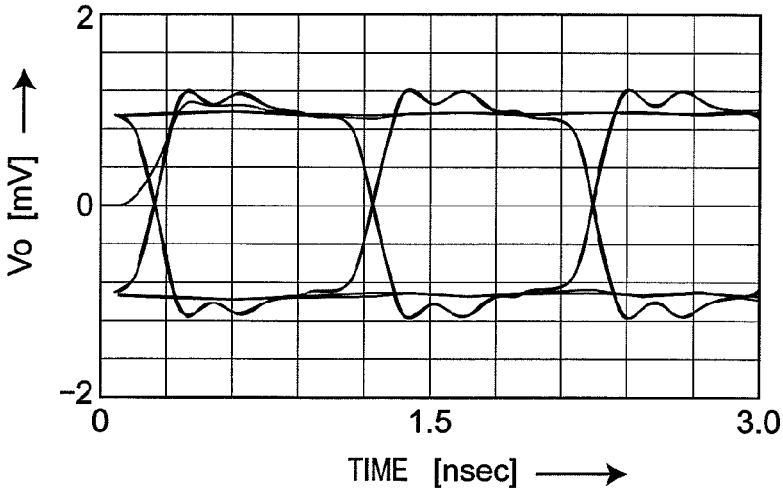
FIG. 20 is a waveform chart showing results of simulations of eye pattern of a received signal received by the antenna apparatus according to the present preferred embodiment.

FIGS. 19 and 20 are waveform charts showing results of the simulation of eye patterns of the received signals received by the antenna apparatuses according to the prior art and the present preferred embodiment, respectively. As shown in FIGS. 19 and 20, in the antenna apparatus according to the present preferred embodiment, the difference between the higher harmonic components and the fundamental frequency component becomes smaller, and therefore, it can be understood that the signal reception with keeping the waveform shape as the rectangular wave can be achieved by reducing the degree of distortion of the rectangular wave as compared with the antenna apparatus according to the prior art.

As described above, according to the antenna apparatus according to the present preferred embodiment, it is possible to reduce the radiation intensity of the fundamental frequency component with respect to the radiation intensity of the higher harmonic components by providing the notched portions 5 and 6 formed at the sides that intersect the E plane at the radiation conductor 3. Therefore, when a wireless digital signal is directly and wirelessly transmitted and received, it is possible to reduce the waveform distortion of the wireless digital signal, which is caused by the higher harmonic components of the rectangular waveforms reduced as compared with the fundamental frequency component.

In addition, since the operation of reducing the fundamental frequency component of the rectangular waveform to be transmitted is performed by employing passive devices, the circuit configuration is simple, and it is possible to reduce the power consumption as compared with the power consumption when active devices are employed.

Figure 21:
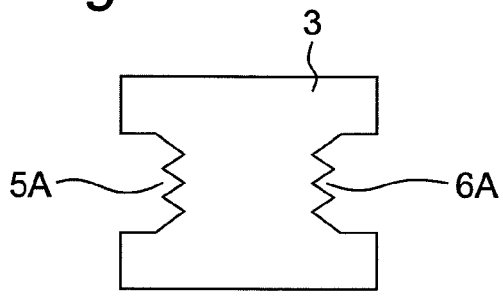
FIG. 21 is a plan view showing a first example of shapes of notched portions 5A to 5D and 6A to 6D, and a radiation conductor 3 of an antenna apparatus according to a modified preferred embodiment of the first preferred embodiment of the present invention.
Figure 22:
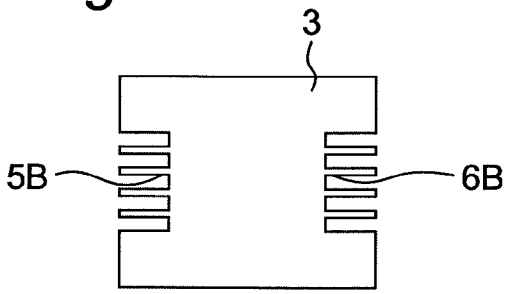
FIG. 22 is a plan view showing a second example of shapes of notched portions 5A to 5D and 6A to 6D, and a radiation conductor 3 of an antenna apparatus according to a modified preferred embodiment of the first preferred embodiment of the present invention.
Figure 23:
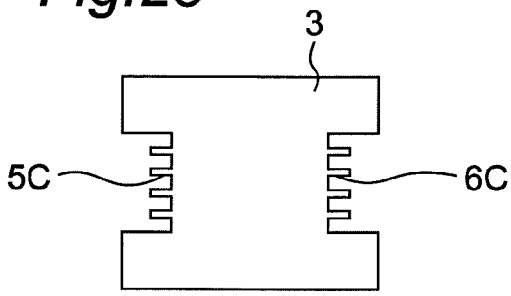
FIG. 23 is a plan view showing a third example of shapes of notched portions 5A to 5D and 6A to 6D, and a radiation conductor 3 of an antenna apparatus according to a modified preferred embodiment of the first preferred embodiment of the present invention.
Figure 24:
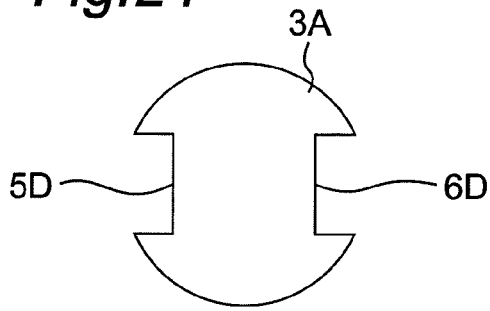
FIG. 24 is a plan view showing a fourth example of shapes of notched portions 5A to 5D and 6A to 6D, and a radiation conductor 3 of an antenna apparatus according to a modified preferred embodiment of the first preferred embodiment of the present invention.

In the present preferred embodiment, the notched portions 5 and 6 have rectangular shapes. However, the present invention is not limited to this configuration, and the notched portions 5 and 6 may have other shapes as shown in, for example, FIGS. 21 to 23. In addition, the radiation conductor 3, which has a rectangular shape, may have another shape as shown in, for example, FIG. 24. It is needless to say that various modifications can be considered for the notched portions 5 and 6, and the radiation conductor 3 in addition to the shapes shown in FIGS. 21 to 24. Further, the shapes of the notched portion 5 and the notched portion 6 may be different from each other. In addition, it is acceptable to provide either one of the notched portions 5 and 6.

In addition, the feeder was the coaxial cable 10 of the back surface coaxial feed system, however, the present invention is not limited to this, and a coplanar type feed system, an electromagnetic coupling type system or the like may be employed.

Second Preferred Embodiment

Figure 25:
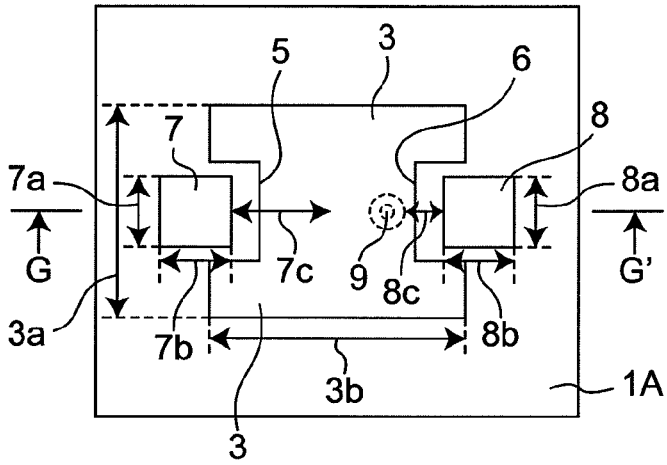
FIG. 25 is a plan view showing a configuration of an antenna apparatus according to a second preferred embodiment of the present invention.
Figure 26:
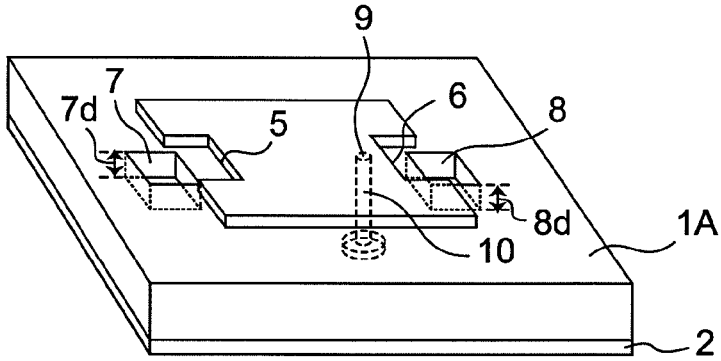
FIG. 26 is a perspective view corresponding to FIG. 25.
Figure 27:
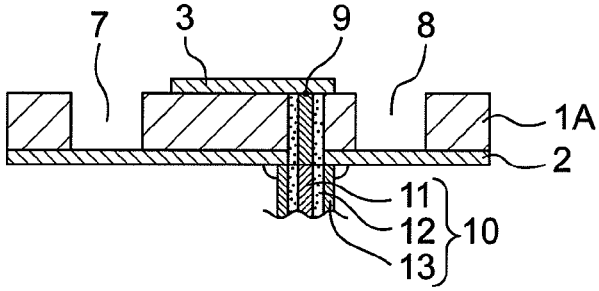
FIG. 27 is a longitudinal sectional view of a G-G' plane of FIG. 25.

FIG. 25 is a plan view showing a configuration of an antenna apparatus according to a second preferred embodiment of the present invention, FIG. 26 is a perspective view corresponding to FIG. 25, and FIG. 27 is a longitudinal sectional view of a G-G' plane of FIG. 25. The antenna apparatus according to the present preferred embodiment is different from the antenna apparatus according to the first preferred embodiment shown in FIGS. 1 to 3 in that a dielectric substrate 1A is provided in place of the dielectric substrate 1. The other points are similar to those of the first preferred embodiment shown in FIGS. 1 to 3, and no detailed description is provided for the components denoted by the same reference numerals.

Referring to FIGS. 25 to 27, the dielectric substrate 1A has concave grooves 7 and 8, which are opened on the surface of the dielectric substrate 1A, and are formed in positions that intersect the E plane in the vicinity of the notched portion 5 and 6. The grooves 7 and 8 have lengths 7*b* and 8*b*, widths 7*a* and 8*a* and depths 7*d* and 8*d*, respectively. Each of the depths 7*d* and 8*d* of the grooves 7 and 8 is equal to the thickness of the dielectric substrate 1. Each of the widths 7*a* and 8*a* of the grooves 7 and 8 is set to be shorter than one third of the cycle length Ls of the standing wave distribution. In addition, the groove 7 is formed in a position located at a distance 7*c* apart from the position of a center of gravity of the radiation conductor 3, and the groove 8 is formed in a position located at a distance 8*c* apart from the feed point 9. The grooves 7 and 8 are formed symmetrically with respect to the H plane.

According to the above configuration, by providing the grooves 7 and 8 on the dielectric substrate 1, the field intensity of the dielectric substrate 1 in the vicinity of the grooves 7 and 8 becomes smaller than that of the other portions of the dielectric substrate 1, and this leads to a reduced magnetic current. This exhibits an advantageous effect of reducing the mutual coupling coefficient between the inductors in the equivalent circuit, in a manner similar to that of the first preferred embodiment. As a result, it is possible to selectively reduce the electromagnetic coupling in the fundamental wave mode, and suppress the fundamental frequency component of the electric field.

As described above, according to the antenna apparatus according to the present preferred embodiment, by providing the convex grooves 7 and 8 on the dielectric substrate 1, it is possible to reduce the waveform distortion caused by the higher harmonic components of rectangular waveforms reduced as compared with the fundamental frequency component when wireless digital signals are directly and wirelessly transmitted and received.

Figure 28:
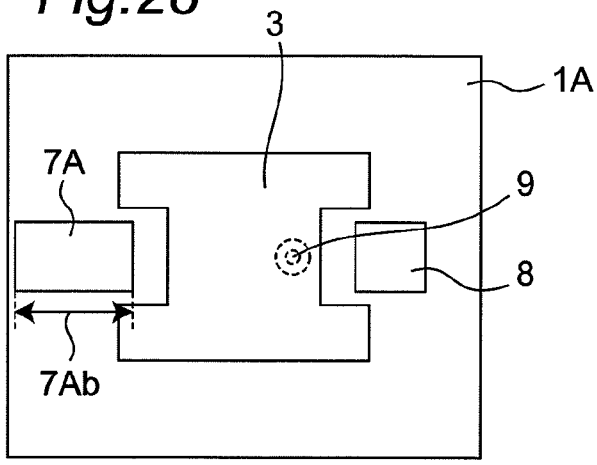
FIG. 28 is a plan view showing a first example of positions of grooves 7A to 7C of an antenna apparatus according to a modified preferred embodiment of the second preferred embodiment of the present invention.
Figure 29:
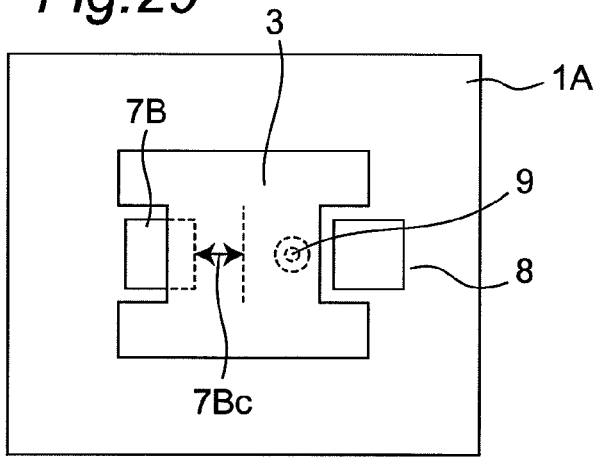
FIG. 29 is a plan view showing a second example of positions of grooves 7A to 7C of an antenna apparatus according to a modified preferred embodiment of the second preferred embodiment of the present invention.
Figure 30:
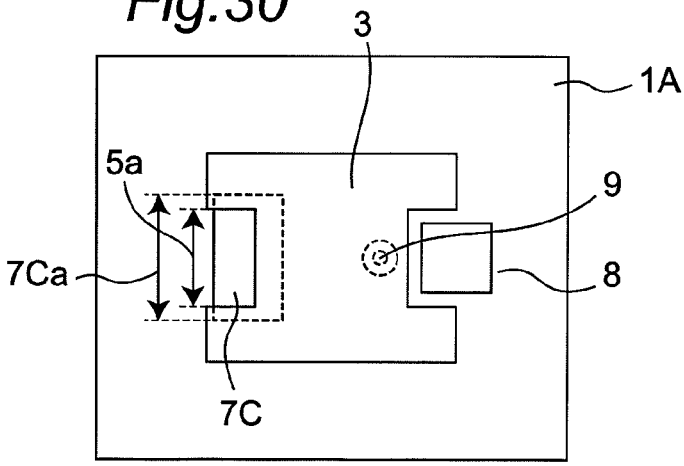
FIG. 30 is a plan view showing a third example of positions of grooves 7A to 7C of an antenna apparatus according to a modified preferred embodiment of the second preferred embodiment of the present invention.

In the present preferred embodiment, the positions, where the grooves 7 and 8 are formed as shown in FIGS. 25 to 27, are only examples, and the grooves 7 and 8 may be located in other positions as shown in, for example, FIGS. 28 to 30. Referring to FIG. 28, a groove 7A may be formed in place of the groove 7, a length 7Ab of the groove 7A may be larger than the length 7*b* of the groove 7 shown in FIGS. 25 to 27, and the groove 7A may extend to a vicinity of the end portion of the dielectric substrate 1. The groove 7A may be formed in a position located within a range from the end portion of the dielectric substrate 1 to the position of the center of gravity of the radiation conductor 3 or the feed point 9. Referring to FIG. 29, a groove 7B may be formed in place of the groove 7, the distance 7Bc of the groove 7B from the position of the center of gravity of the radiation conductor 3 may be smaller than the distance 7*c* of the groove 7 from the position of the center of gravity of the radiation conductor 3 shown in FIGS. 25 to 27, and a part of the groove 7B may overlap a part of the radiation conductor 3. By forming the groove 7B so that a part thereof overlap a part of the radiation conductor 3, the electrostatic capacitance of the capacitor C12 (See FIG. 13) in the equivalent circuit can be reduced, and this exhibits such an advantageous effect that designs with various electrostatic capacitances of the antenna portion can be easily achieved. In addition, referring to FIG. 30, a groove 7C may be formed in place of the groove 7, the width 7Ca of the groove 7C may be larger than the width 7*a* of the groove 7 shown in FIGS. 25 to 27, and the groove 7C may overlap a part of the radiation conductor 3. The width 7Ca of the groove 7C may be set to an arbitrary value so that the width becomes shorter than one third of a sum of the width $L_C$ and the length $L_B$ of the entire radiation conductor 3. Although the grooves 7A, 7B and 7C of the modified preferred embodiments of the groove 7 are shown in FIGS. 28 to 30, it is needless to say that modified preferred embodiments similar to those described above can be considered with regard to the groove 8.

In addition, each of the depths 7*d* and 8*d* of the grooves 7 and 8 is equal to the thickness of the dielectric substrate 1. However, the present invention is not limited to this configuration, and each of the depths 7*d* and 8*d* of the grooves 7 and 8 may have any arbitrary value selected within a range from zero to a value equal to the thickness of the dielectric substrate 1. In addition, the length 7*b*, width 7*a* and depth 7*d* of the groove 7 are the same as the length 8*b*, width 8*a* and depth 8*d* of the groove 8, respectively, however, they may be set to values different from each other. Further, the grooves 7 and 8 have rectangular shapes in plan view, however, the present invention is not limited to this, and the grooves 7 and 8 may have the other shapes such as a circular shape.

In addition, both of the notched portions 5 and 6 and the grooves 7 and 8 are provided in the present preferred embodiment, however, only grooves 7 and 8 may be provided without providing the notched portions 5 and 6.

Implemental Example

Simulation results concerning the antenna apparatuses of the prior art and the preferred embodiments obtained by the inventor are described below.

Figure 31:
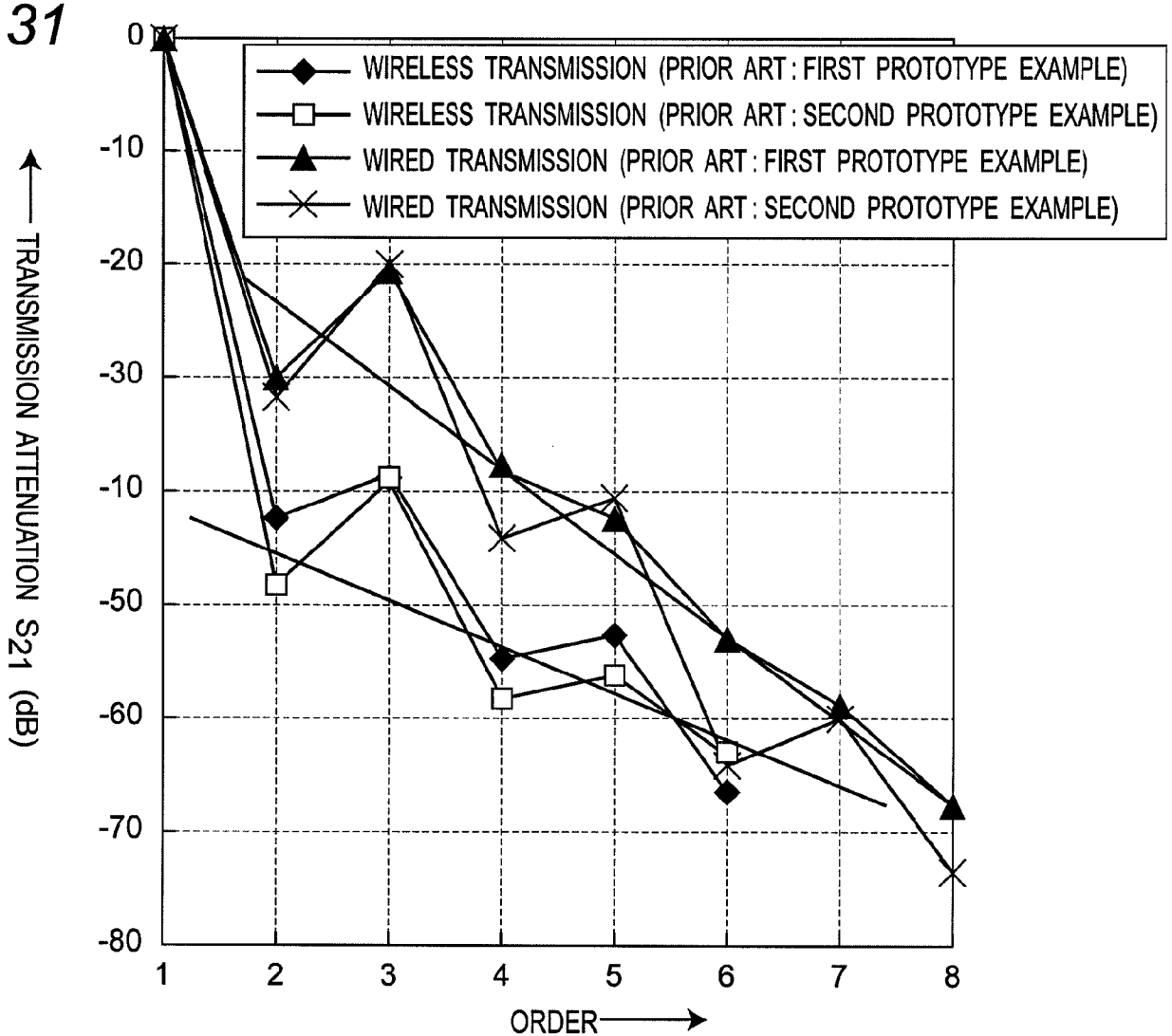
FIG. 31 is a graph showing a transmission attenuation $S_{21}$ [dB] of a transmission signal in a fundamental wave mode and a second and higher order harmonic modes, when each of a wireless transmission system and a wired transmission system is formed by making a pair of prior art oval dipole wideband antenna apparatuses (which are prototype antennas made by the inventor, and there are two prototype examples.) opposed to each other.

FIG. 31 is a graph showing a transmission attenuation $S_{21}$ [dB] of a transmission signal in a fundamental wave mode and a second and higher order harmonic modes, when each of a wireless transmission system and a wired transmission system is formed by making a pair of prior art oval dipole wideband antenna apparatuses (which are prototype antennas made by the inventor, and there are two prototype examples.) opposed to each other. Referring to FIG. 31, straight lines other than the polygonal lines connecting the plotted points are linearly approximated straight lines in the wireless transmission system and the wired transmission system. As apparent from FIG. 31, the signal levels of the second and higher order harmonic components are largely attenuated as compared with the signal level of the fundamental wave component in both of the wireless transmission system and the wired transmission system.

Figure 32:
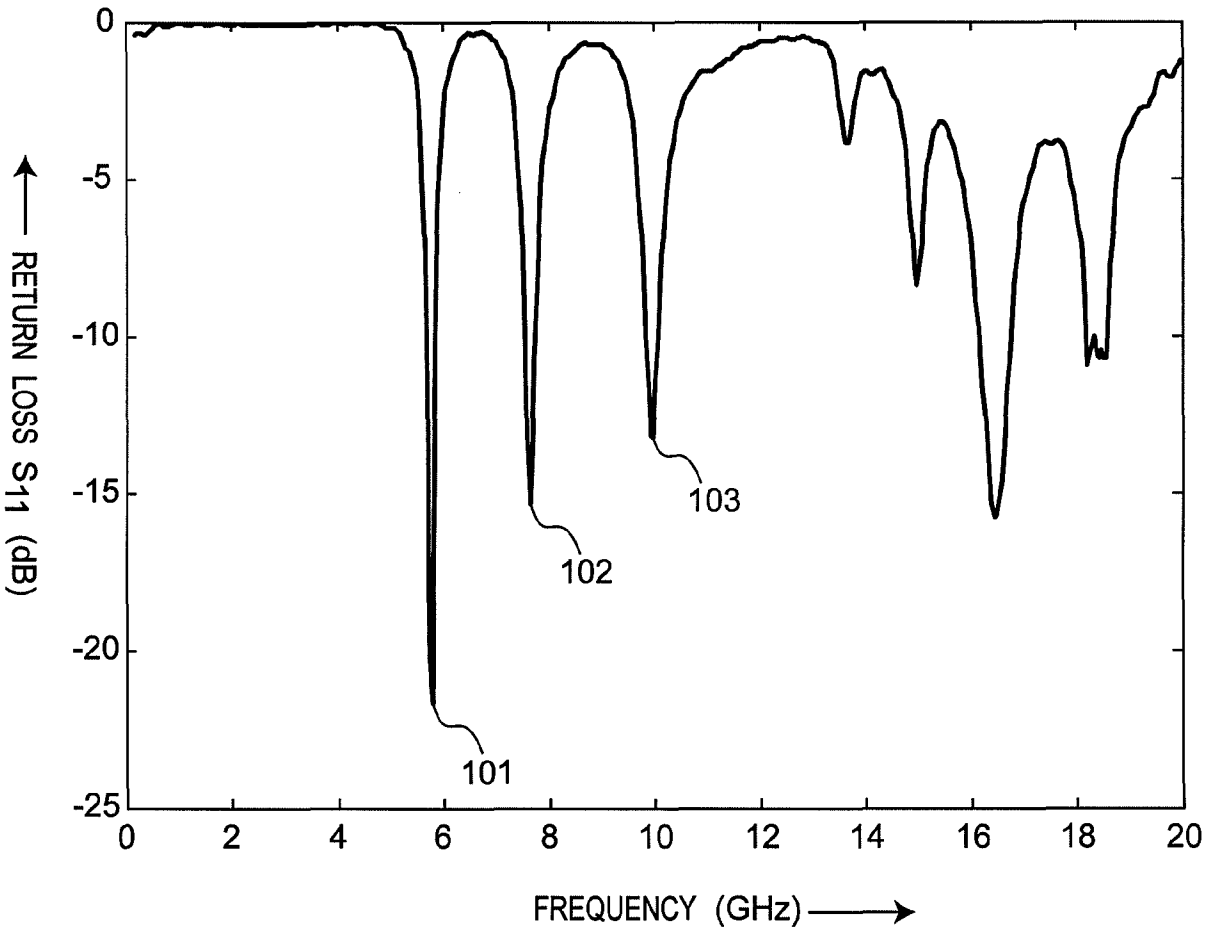
FIG. 32 is a spectrum chart showing frequency characteristics of a return loss $S_{11}$ [dB] in square-shaped rectangular patch antenna apparatus according to a prior art.
Figure 33:
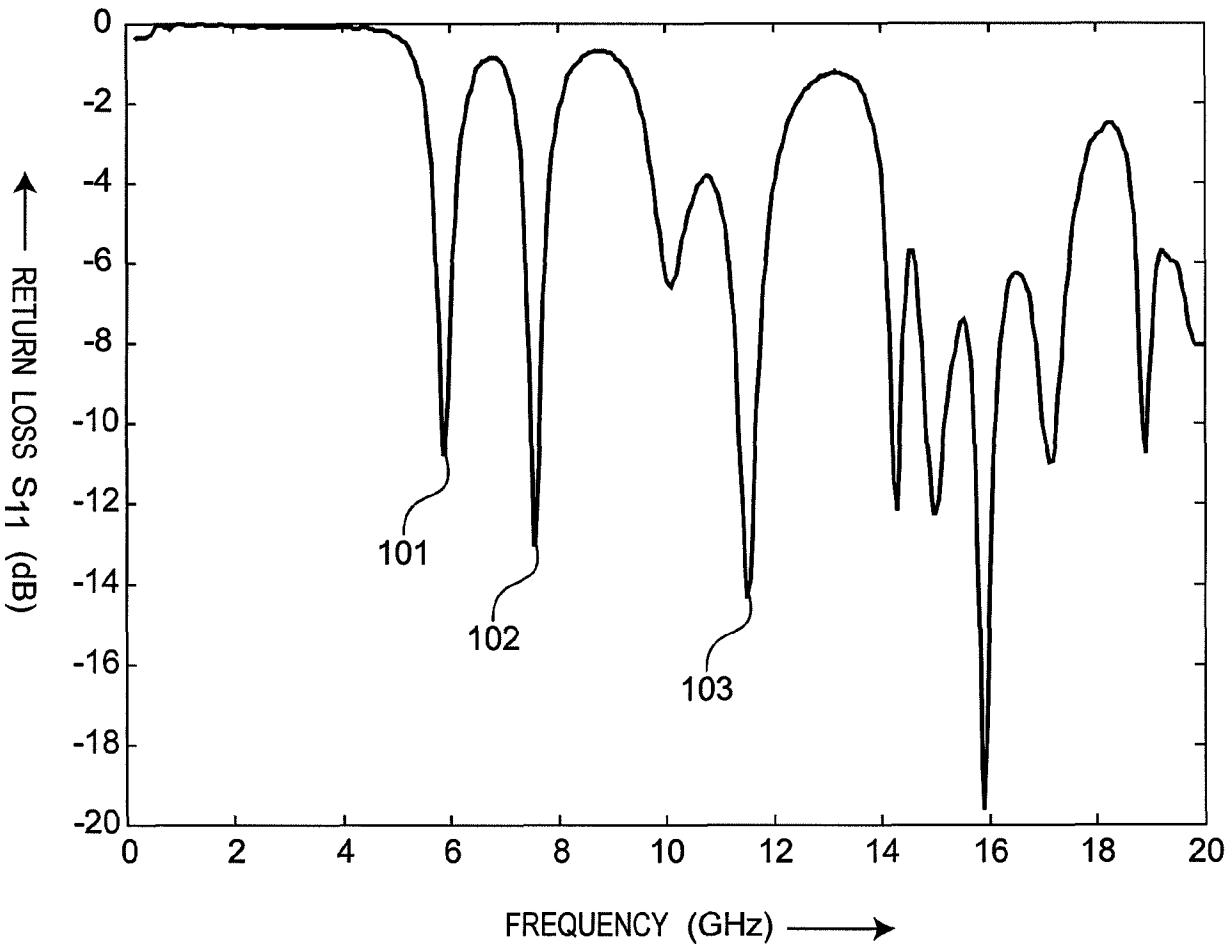
FIG. 33 is a spectrum chart showing frequency characteristics of the return loss $S_{11}$ [dB] in the antenna apparatus according to the first preferred embodiment.
Figure 34:
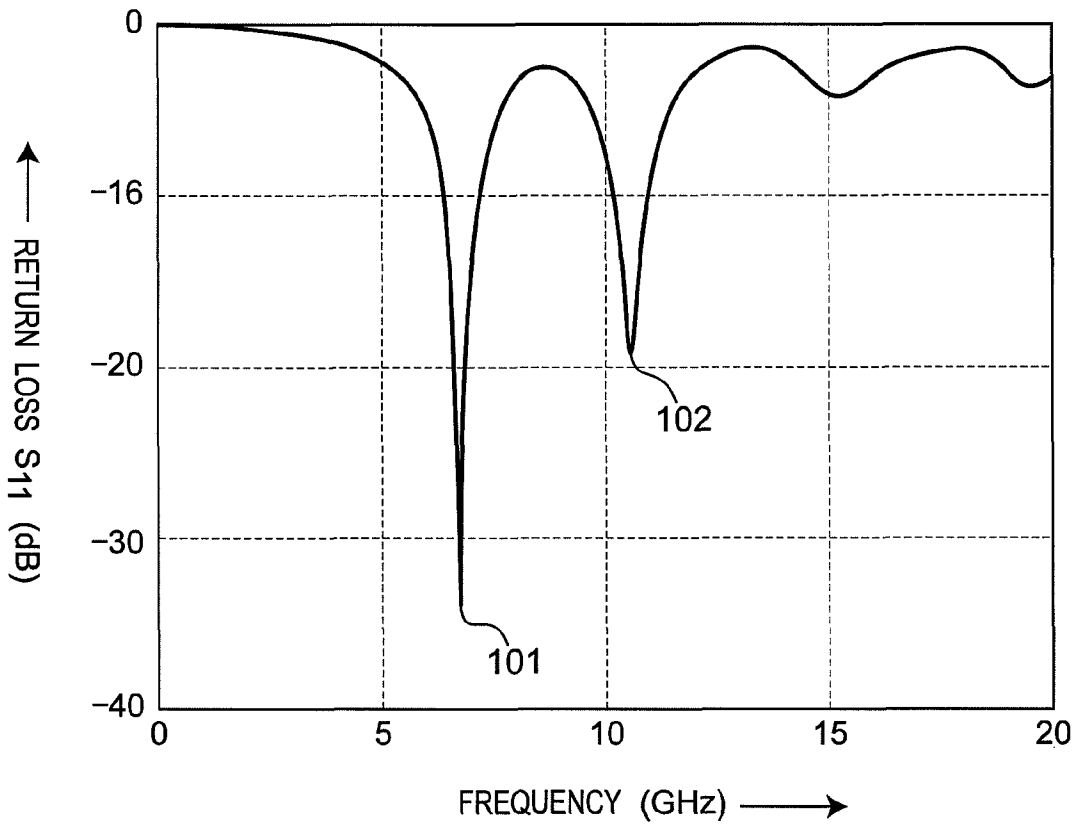
FIG. 34 is a spectrum chart showing frequency characteristics of the return loss $S_{11}$ [dB] in a rectangular loop slot antenna apparatus according to a prior art (an antenna apparatus of FIG. 4 of the Patent Document 3, in which a ground conductor is formed and provided via a slot of a predetermined width around a patch conductor of the rectangular patch antenna apparatus of FIG. 32)
Figure 35:
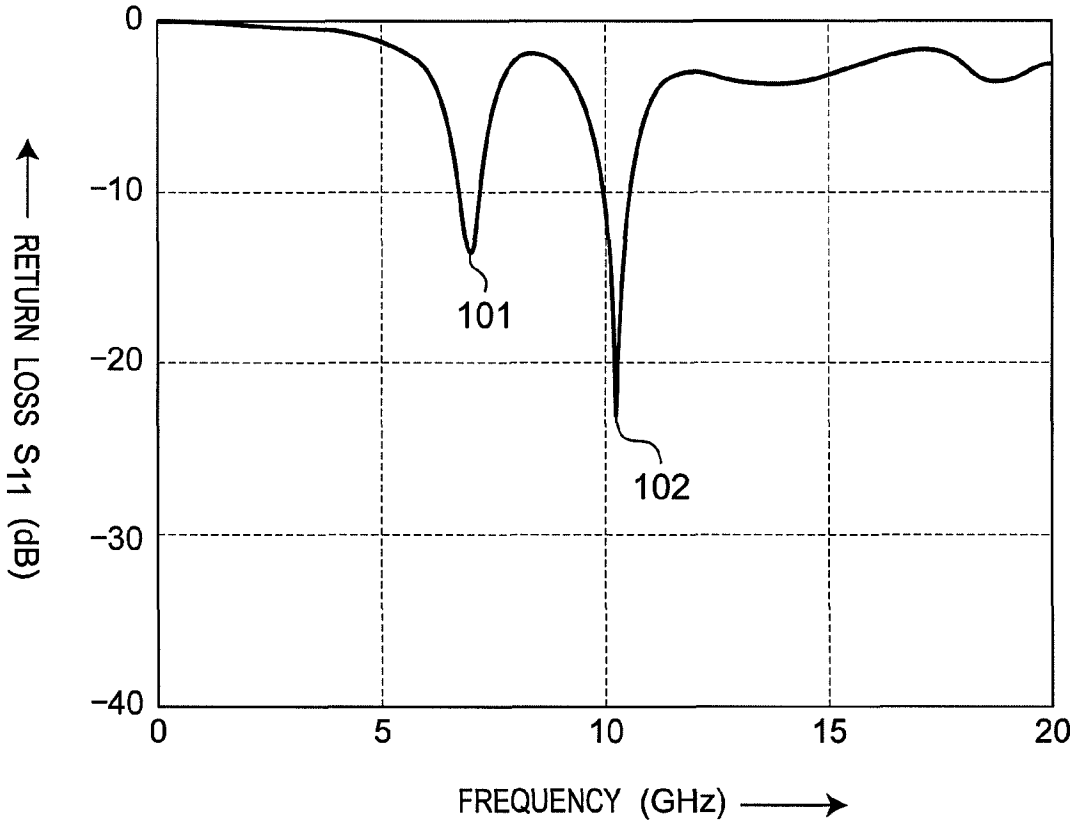
FIG. 35 is a spectrum chart showing frequency characteristics of the return loss $S_{11}$ [dB] in a rectangular loop slot antenna apparatus according to a prior art (an antenna apparatus of FIG. 1 of the Patent Document 3, in which a ground conductor is formed and provided via a slot of a predetermined width around an H-shaped patch conductor).

Next, comparison results of the return loss $S_{11}$ in the following four antenna apparatuses are shown below. FIG. 32 is a spectrum chart showing frequency characteristics of a return loss $S_{11}$ [dB] in square-shaped rectangular patch antenna apparatus according to a prior art (a first comparative example), and FIG. 33 is a spectrum chart showing frequency characteristics of the return loss $S_{11}$ [dB] in the antenna apparatus according to the first preferred embodiment. In addition, FIG. 34 is a spectrum chart showing frequency characteristics of the return loss $S_{11}$ [dB] in a rectangular loop slot antenna apparatus according to a prior art (an antenna apparatus of FIG. 4 of the Patent Document 3, in which a ground conductor is formed and provided via a slot of a predetermined width around a patch conductor of the rectangular patch antenna apparatus of FIG. 32: a second comparative example). Further, FIG. 35 is a spectrum chart showing frequency characteristics of the return loss $S_{11}$ [dB] in a rectangular loop slot antenna apparatus according to a prior art (an antenna apparatus of FIG. 1 of the Patent Document 3, in which a ground conductor is formed and provided via a slot of a predetermined width around an H-shaped patch conductor: a third comparative example). Referring to FIGS. 32 to 35, the reference numeral 101 denotes the return loss $S_{11}$ [dB] in the fundamental wave mode, the reference numeral 102 denotes the return loss $S_{11}$ [dB] in the second-order harmonic wave mode, and the reference numeral 103 denotes the return loss $S_{11}$ [dB] in the third-order harmonic wave mode. Referring to FIGS. 32 to 35, resonance occurs at a local minimum point of the return loss, and, generally speaking, the transmission signal level becomes larger when the return loss at the frequency of the resonance point is smaller.

As apparent from the comparisons among FIGS. 32 and 33, the present preferred embodiment exhibits an advantageous effect of raising the signal level in the third-order harmonic wave mode while lowering the transmission signal level in the fundamental wave mode (by the effect of forming the notched portions). In addition, as apparent from FIGS. 34 and 35, the transmission signal level in the fundamental wave mode changes, however, it is not possible to obtain the advantageous effect of raising the signal levels in the third and higher degree harmonic wave modes, since it is not possible to obtain the resonance in the third and higher degree harmonic wave modes.

According to the antenna apparatus of the present invention, the radiation conductor has at least one notched portion formed at at least one side of sides of the radiation conductor so that at least a third-order harmonic signal level becomes larger than a fundamental wave signal level, where the sides intersects an electric field plane defined by an electric field when the antenna apparatus is excited. Therefore, it is possible to reduce the radiation intensity of the fundamental frequency component as compared with the radiation intensity of the higher harmonic components, and it is possible to remarkably reduce the waveform distortion caused by the higher harmonic components of rectangular waveforms reduced as compared with the fundamental frequency component when a wireless digital signal is directly and wirelessly transmitted and received by the baseband transmission.

In addition, since the operation of reducing the fundamental frequency component of the rectangular waveform to be transmitted is performed by employing passive devices, the circuit configuration is simple, and it is possible to reduce the power consumption as compared with the power consumption when active devices are employed.

The antenna apparatus according to the present invention can be used for, for example, a wireless bus, a wireless interconnection and the like for directly and wirelessly transmitting and receiving wireless digital signals.

The invention claimed is:

1. An antenna apparatus, comprising:

a dielectric substrate including a ground conductor formed on a back surface of the dielectric substrate;

a radiation conductor formed on a front surface of the dielectric substrate, the antenna apparatus configured to directly transmit and receive a wireless digital signal by baseband transmission via a feed point of the radiation conductor; and at least one notched portion formed substantially at a center position on one side of the radiation conductor, which intersects an electric field plane of the radiation conductor, wherein the radiation conductor reduces waveform distortion of a transmitted wireless digital signal by forming the at least one notched portion on the one side of the radiation conductor, which intersects the electric field plane defined by an electric field when the antenna apparatus is excited, so that at least a third-order harmonic signal level becomes larger than a fundamental wave signal level, the dielectric substrate further comprises at least one groove, which is formed in at least one position that intersects the electric field plane in the vicinity of the at least one notched portion, the dielectric substrate includes at least two grooves, and the two grooves are formed symmetrically with respect to the magnetic field plane.

2. The antenna apparatus of claim 1, wherein the at least one notched portion is formed so that at least the third-order harmonic signal level becomes larger than the fundamental wave signal level and a second-order harmonic signal level.

3. The antenna apparatus of claim 1, wherein a sum of lengths of notched portions onsides of the radiation conductor is set to be shorter than one-sixth of a length of a whole circumference of the radiation conductor when the notched portions are not formed.

4. The antenna apparatus of claim 1, wherein the at least one notched portion is formed so as not to be located at one of a position of a center of gravity of the radiation conductor and the feed point.

5. The antenna apparatus of claim 1, further comprising a notch portion formed on another side of the radiation conductor, wherein the notched portion is positioned to oppose the at least one notched portion and both notch portions are formed on sides of the radiation conductor that intersect the electric field plane, respectively, and are formed symmetrically with respect to a magnetic field plane orthogonal to the electric field plane.

6. The antenna apparatus of claim 1, wherein a depth of each groove is set to one value selected within a range from zero to a value equal to a thickness of the dielectric substrate.

7. The antenna apparatus of claim 1, wherein a sum of lengths of sides of a groove parallel to sides of the radiation conductor is set to be shorter than one-sixth of a length of a whole circumference of the radiation conductor when notched portions are not formed on the radiation conductor.

8. The antenna apparatus of claim 1, wherein each groove is formed at a position located within a range from an end portion of the dielectric substrate to a position of a center of gravity or the feed point of the radiation conductor.

* * * * *